US006116038A

United States Patent [19]

Yamada et al.

[11] Patent Number: 6,116,038

[45] Date of Patent: Sep. 12, 2000

[54] ICE MAKING APPARATUS

[75] Inventors: Hatsuo Yamada; Tadashi Sakai; Sonoo Kato, all of Aichi-Ken, Japan

[73] Assignee: Hoshizaki Denki Kabushiki Kaisha, Aichi-ken, Japan

[21] Appl. No.: 09/218,006

[22] Filed: Dec. 22, 1998

[30] Foreign Application Priority Data

Dec. 25, 1997 [JP] Japan ..... 9-357480

[51] Int. Cl.[7] ..... F25C 1/12

[52] U.S. Cl. ..... 62/259.1; 62/298; 62/347

[58] Field of Search ..... 62/259.1, 298, 62/347; 248/550.21, 300

[56] References Cited

U.S. PATENT DOCUMENTS

| | | | |
|---|---|---|---|
| 2,681,164 | 6/1954 | Kalfen | 248/300 |
| 3,426,284 | 2/1969 | Trachetnberg et al. | 248/300 |
| 3,528,636 | 9/1970 | Schmidt | 248/300 |
| 5,433,414 | 7/1995 | Vieira | 248/300 |
| 5,483,777 | 1/1996 | Menchetti et al. | 248/300 |

OTHER PUBLICATIONS

New U.S. Patent Application filed Dec. 22, 1998, Hatsuo Yamada et al., entitled "Flowing–Down Ice Making Apparatus".

*Primary Examiner*—William E. Tapolcai

*Attorney, Agent, or Firm*—Wenderoth, Lind & Ponack, L.L.P.

[57] ABSTRACT

An ice making apparatus comprises: an ice making unit including ice making plates having ice making surfaces, and a water sprinkler for sprinkling ice water on the ice making surfaces; a reservoir tank for receiving the ice water flowing down on the ice making surfaces; and a feed pump including a pump section for supplying the ice water reserved in the reservoir tank to the water sprinkler, and a motor section for driving the pump section. The pump section is accommodated, together with the ice making unit and the reservoir tank, in an ice making chamber formed within a main body of the ice making apparatus. The motor section is accommodated, together with a control box containing therein various electrical components, in an upper machine chamber formed within the main body. The upper machine chamber is formed at the back of the ice making chamber and is partitioned from the ice making chamber by an L-shaped thermally insulating panel. The control box is detachably fixed onto the front wall surface of the upper machine chamber by a control box fixing plate attached to the front wall surface of the upper machine chamber so that the control box fixing plate faces the front surface of the control box. When the control box is taken out from the upper machine chamber, there is no need to remove a number of screws from the control box nor to move the main body. As a result, the control box can be readily taken out from the upper machine chamber.

11 Claims, 14 Drawing Sheets

ICE MAKING APPARATUS

BACKGROUND OF THE INVENTION

1. Field of the Invention

The present invention relates to an ice making apparatus for producing ice cubes such as crescent ice.

2. Description of the Related Art

Ice cubes such as crescent ice are typically produced by an ice making apparatus illustrated in FIG. 18. In this figure, an ice making apparatus 70 comprises an ice making unit 74 including ice making plates for making ice cubes thereon and a water sprinkler 73 for distributing or sprinkling ice water onto the ice making surface of each ice making plate, and a reservoir tank 76 for receiving the ice water flowing down along the ice making surface of the ice making unit 74. The ice water reserved in the reservoir tank 76 is supplied into the water sprinkler 73 in the ice making unit 74 by a feed pump 77 including a pump section 77*a* and a motor section 77*b* for driving the pump section 77*a*.

The pump section 77*a* of the feed pump 77, the ice making unit 74, and the reservoir tank 76 are all accommodated in an ice making chamber 72 formed inside a main body 71 in the ice making apparatus 70. The ice making chamber 72 is formed of a thermally insulating material to reduce the influence of the outside air temperature.

The motor section 77*b* of the feed pump 77, and a control box 79 containing therein various electrical components are both accommodated in an upper machine chamber 78 formed in the main body 71. The upper machine chamber 78 is partitioned from the ice making chamber 72 by a thermally insulating panel formed at the back of the ice making unit 74, and has a ceiling surface constituted by a top plate 71*a* of the main body 71.

When the top plate 71*a* is removed from the main body 71, the control box 79 accommodated in the upper machine chamber 78 is exposed. Therefore, even if electrical components (not shown) within the control box 79 are repaired, the control box 79 can be taken out from the upper machine chamber 78. However, when the control box 79 is taken out from the upper mechanism 78, a number of screws must be released, or the main body 71 must be moved so as to make the mounting surface of the control box 79 laterally oriented. As a result, it is time-consuming to remove the control box 79, and thus much labor and time must have been consumed for repairing the electrical components contained in the control box 79.

SUMMARY OF THE INVENTION

This invention has therefore been made in view of these drawbacks of the conventional ice making machine. An object of this invention is to provide an ice making apparatus capable of readily taking out a control box accommodated in an upper machine chamber of a main body therefrom.

According to the present invention, an ice making apparatus comprises: an ice making unit including and ice making plate having ice making surfaces, and a water sprinkler for distributing ice water to the ice making surfaces of the ice making plate; a reservoir tank for receiving the ice water flowing down along the ice making surfaces; a feed pump including a pump section for supplying the ice water reserved in the reservoir tank to the water sprinkler, and a motor section for driving the pump section; a main body including an ice making chamber for accommodating the ice making unit and the reservoir tank, a thermally insulating panel for forming an upper machine chamber partitioned from the ice making chamber at the back of the ice making chamber, and a top plate constituting a ceiling surface of the upper machine chamber; a control box accommodated together with the motor section of the feed pump in the upper machine chamber; and a control box fixing plate attached to a front wall surface of the upper machine chamber so as to face the front surface of the control box. The control box is detachably fixed to the wall surface of the upper machine chamber by the control box fixing plate.

In a preferred embodiment of the present invention, the control box is formed into a box shape while the front surface is open. Also, in the preferred embodiment of the present invention, the control box fixing plate includes: a fixing edge fixed onto the ceiling surface of the control box by a screw inserted into the control box through the upper surface of the control box; and position determining portions for positioning the side surface of the control box at a predetermined position. The fixing edge is formed by folding the upper end portion of the control box fixing plate substantially at a right angle. The position determining portions are formed by folding both side edges of the control box fixing plate substantially at a right angle.

Further, in the preferred embodiment of the present invention, the control box fixing plate includes a horizontal base plate portion for bearing the control box at the lowest surface thereof. The base plate portion includes: guide portions for guiding the side surfaces of control box to position determining portion; and a rear end portion that is folded so as to face the back surface of the control box. The guide portions are formed by folding the both side edges of the base plate portion substantially at a right angle.

BRIEF DESCRIPTION OF THE DRAWINGS

For a better understanding of the present invention, reference is made to the following detailed description to be read in conjunction with the accompanying drawings, in which.

DETAILED DESCRIPTION OF THE PREFERRED EMBODIMENT

Figure 1:
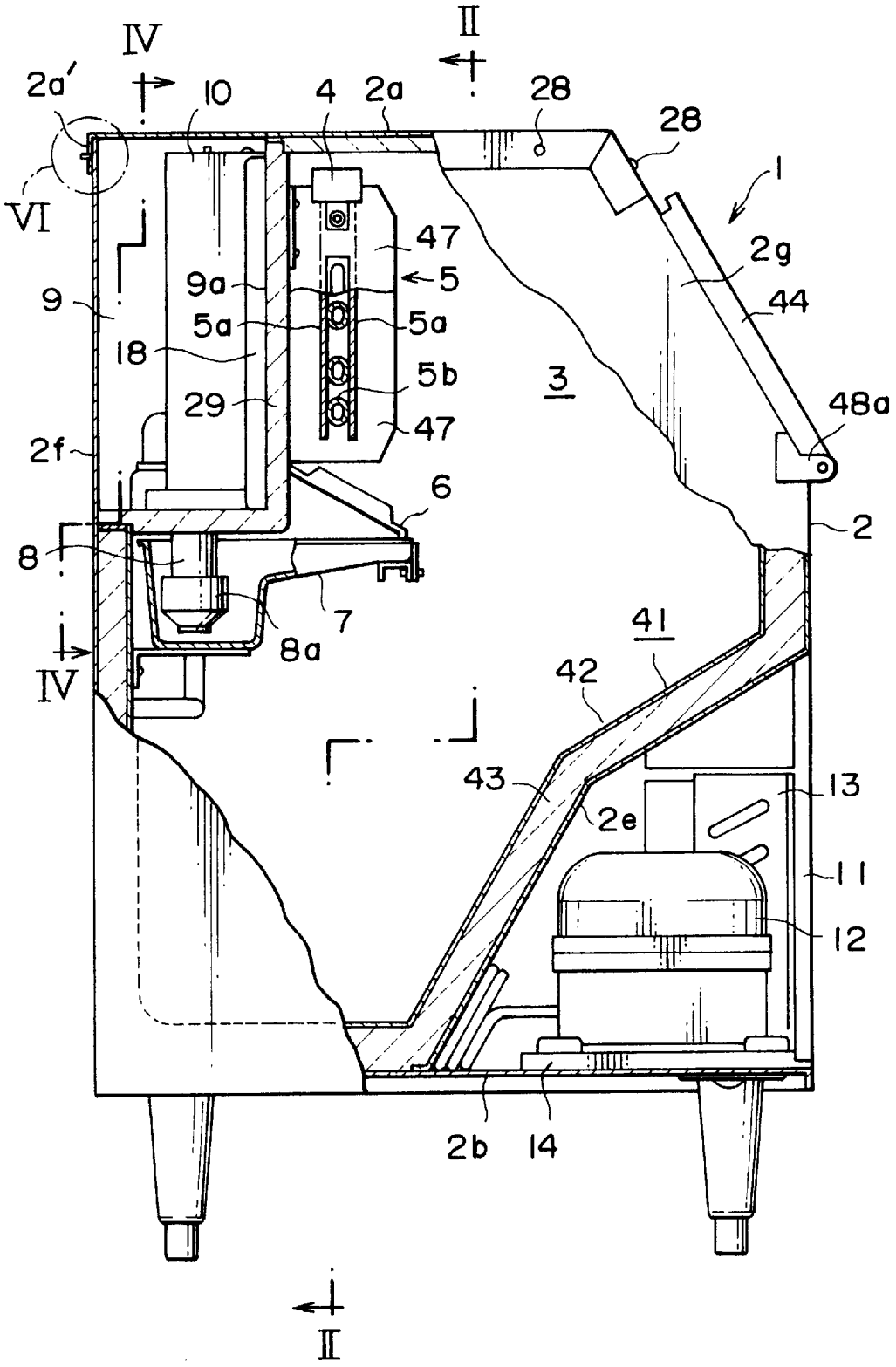
FIG. 1 is a cross-sectional view showing an ice making apparatus in accordance with an embodiment of the present invention.

Referring now to FIG. 1, an ice making apparatus 1 according to an embodiment of the present invention comprises an ice making unit 5 including a pair of substantially vertical ice making plates 5*a* for producing ice cubes, a water sprinkler 4 for sprinkling or distributing ice water to the ice making plates 5*a*, and an evaporation tube 5*b* arranged between the ice making plates 5*a*. The ice making unit 5 is known, and is arranged so that, as can be understood from the above, the metallic evaporation tube 5*b* constituting an evaporator in a freezing circuit is brought into contact with the surfaces of the metallic plates.

Figure 2:
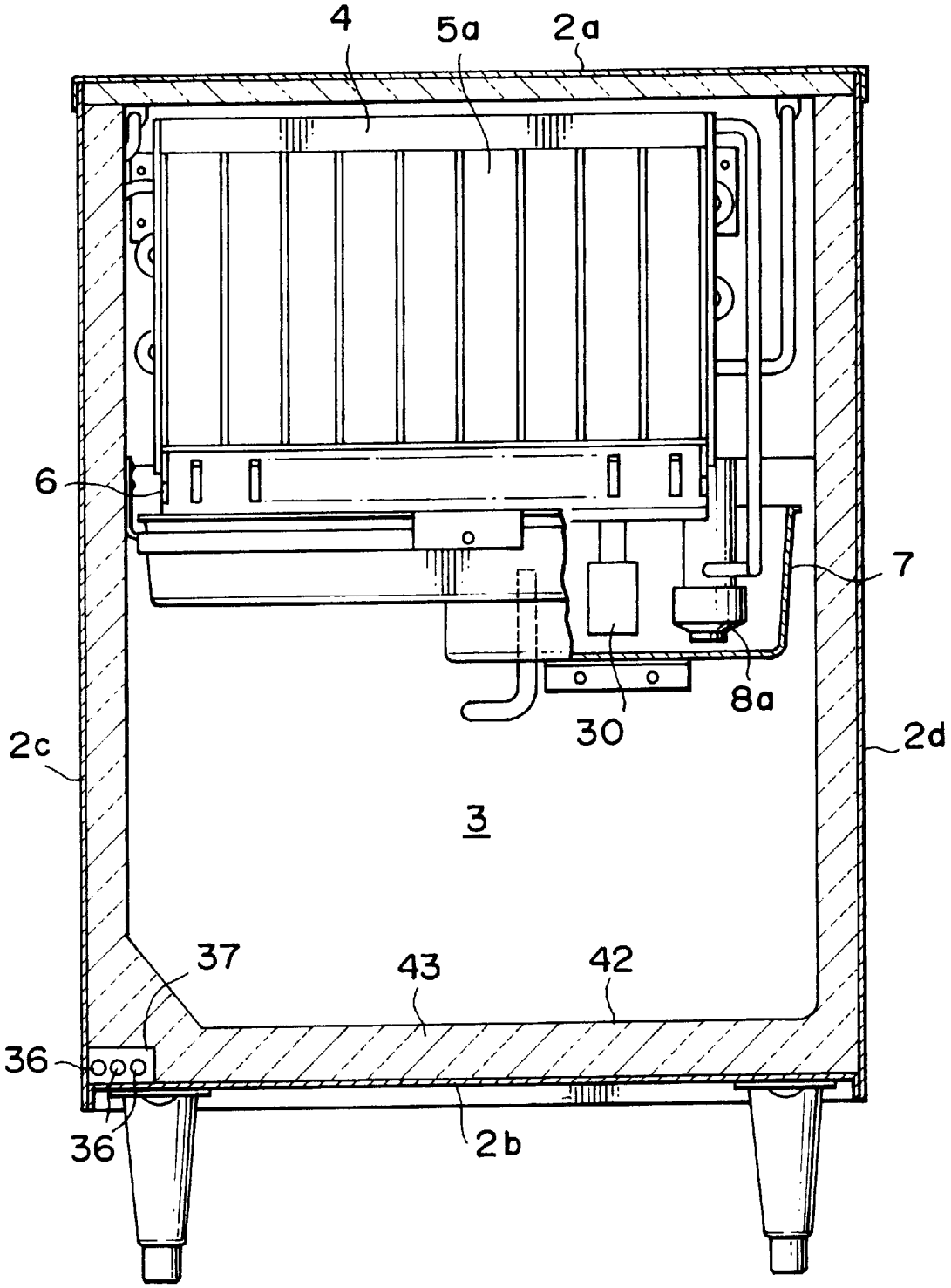
FIG. 2 is a cross-sectional view taken along the line II—II of FIG. 1.
Figure 4:
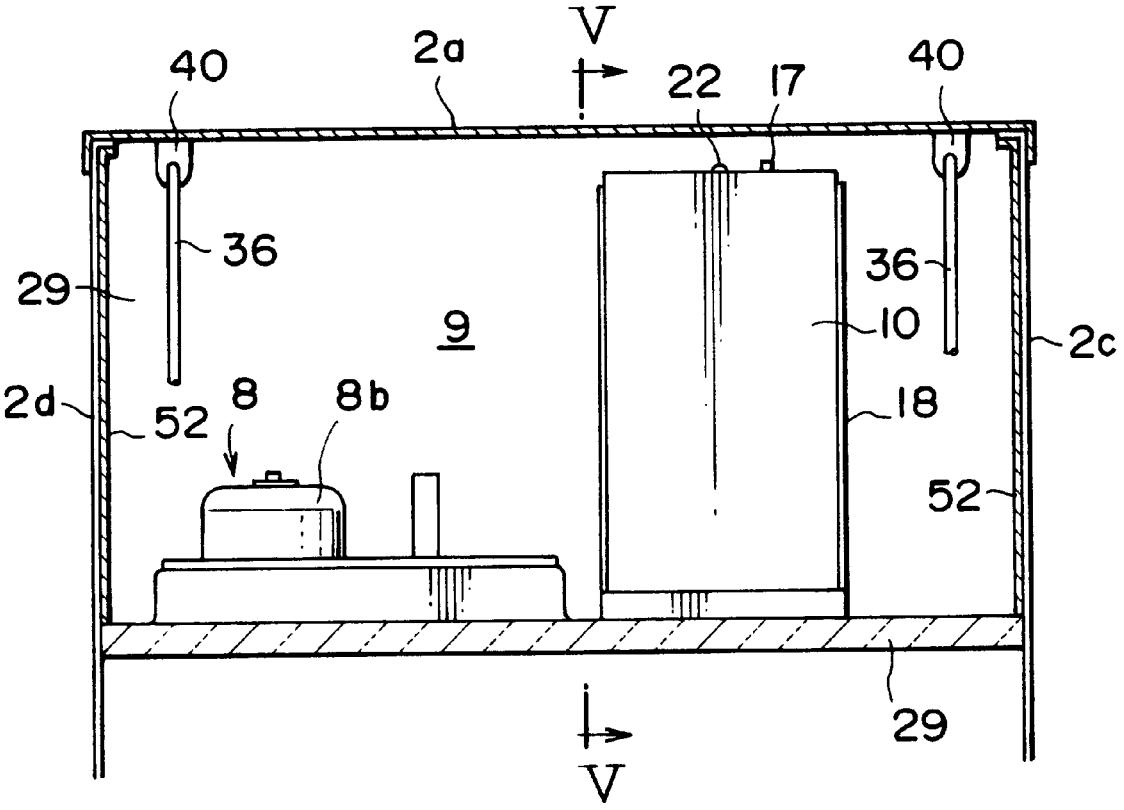
FIG. 4 is a cross-sectional view taken along the line IV—IV of FIG. 1.

The ice water discharged from the water sprinkler 4 in the ice making unit 5 is partially frozen on the ice making surfaces of the ice making plates 5*a*, and the thus frozen ice water is grown, thereby forming ice cubes. Some ice water that is not frozen on the ice making plates 5*a* in the ice making unit 5 flows down along the ice making surfaces of the ice making plates 5*a*, and is then guided to a reservoir tank 7 disposed below the ice making unit 5 to be reserved in this reservoir tank 7. The ice water reserved in the reservoir tank 7 is supplied to the water sprinkler 4 in the ice making unit 5 by a feed pump 8 having a pump section 8*a* and a motor section 8*b* (see FIG. 4) for driving the pump section 8*a*. The feed pump 8 continues to supply the ice water to the water sprinkler 4 until a float switch 30 (see FIG. 2) provided within the reservoir tank 7 turns ON or OFF.

The pump section 8*a* of the feed pump 8, the ice making unit 5, and the reservoir tank 7 are all accommodated in an ice making chamber 3 formed within a main body 2 in the ice making apparatus 1. The ice making chamber 3 is defined by a thermally insulating material such as foamed resin provided therearound to reduce the influence due to the outside air temperature.

The motor section 8*b* of the feed pump 8, and a control box 10 containing therein various electrical components (not shown) are both accommodated in an upper machine chamber 9 defined inside the main body 2. The upper machine chamber 9 is arranged at the back of the ice making chamber 3, and partitioned from the ice making chamber 3 by a thermally insulating panel 29. The thermally insulating panel 29 is formed by folding a single thermally insulating plate substantially at a right angle to present a front wall surface 9*a* of the upper machine chamber 9 and a bottom surface of the upper machine chamber 9.

Figure 6:
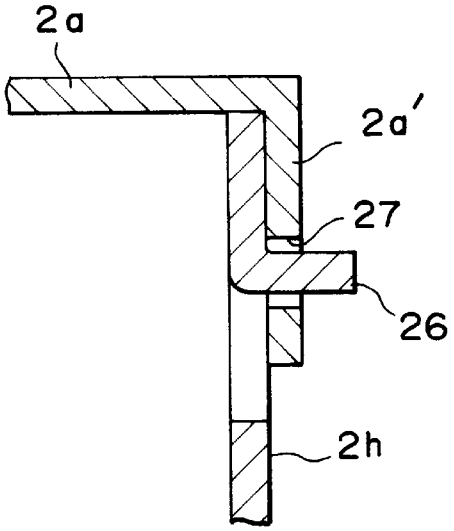
FIG. 6 is a detailed view showing the part VI shown in FIG. 1.

The main body 2 is formed into substantially a box shape, and has a top plate 2*a* constituting a ceiling surface of the upper machine chamber 9. The top plate 2*a* is fixed to the main body 2 at its side surface and front surface by a plurality of screws 28, and it is engaged with the back surface of the main body 2 by an engagement portion 2*a*'. The engagement portion 2*a*' is formed by folding the rear end portion of the top plate 2*a* substantially at a right angle. Provided in the engagement portion 2*a*' is a square hole 27 engaging a plate portion 26 (see FIG. 6) which projects substantially horizontally beyond the back surface of the main body 2.

Figure 11:
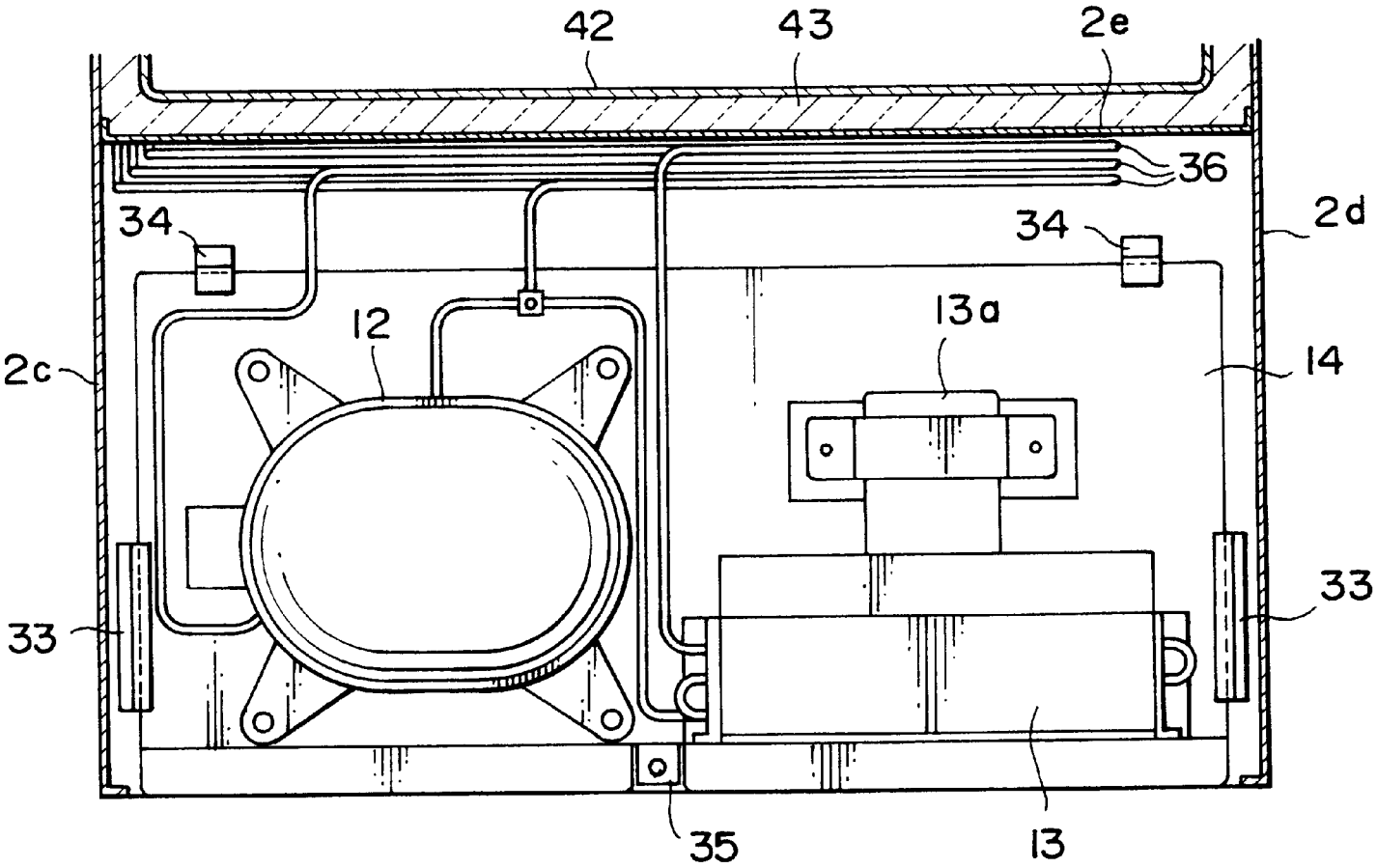
FIG. 11 is a plan view showing a lower machine chamber illustrated in FIG. 1
Figure 17:
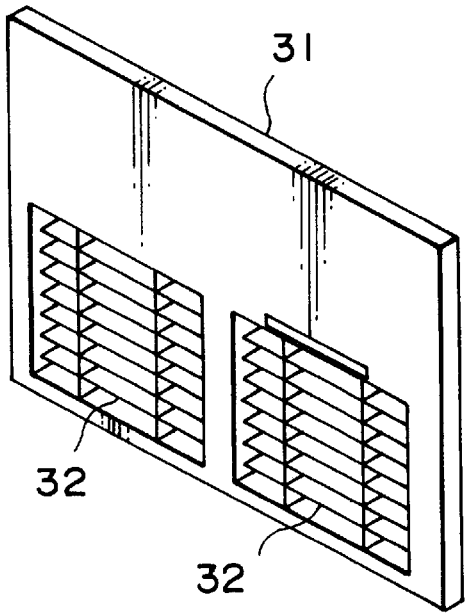
FIG. 17 is a perspective view showing a front panel of the ice making apparatus illustrated in FIG. 1.
Figure 18:
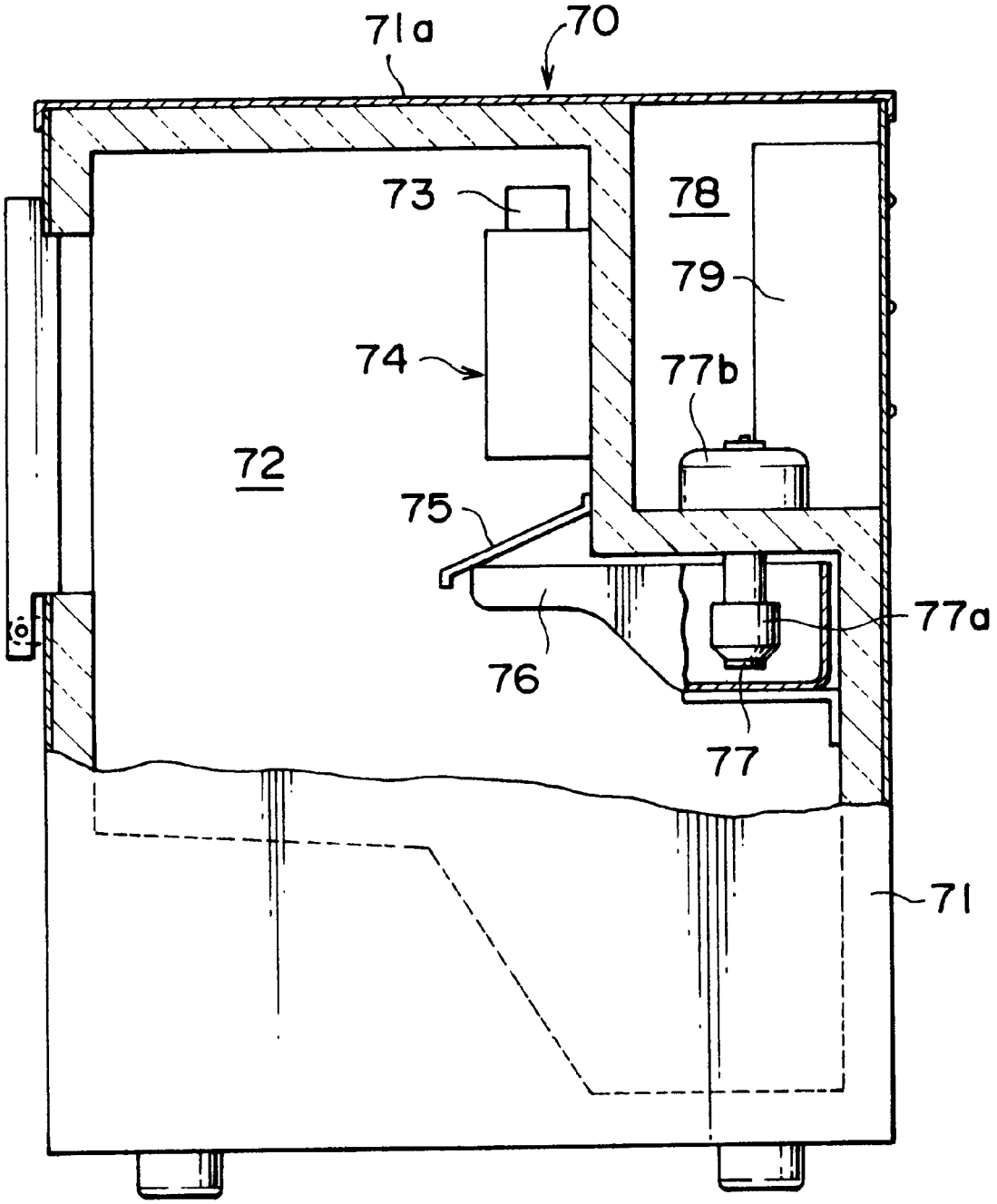
FIG. 18 PRIOR ART
FIG. 18 is a cross-sectional view showing a conventional ice making apparatus.

A freezing unit including a compressor 12 and a condenser 13 is received in a lower machine chamber 11 formed within the main body 2. A front panel 31 (see FIG. 17) concealing a front opening of the lower machine chamber 11 is formed into substantially a rectangular shape, including a louver 32 for the purpose of air-intake and air-exhaust. A drawer plate 14 for drawing out the freezing unit including the compressor 12 and the condenser 13 from the lower machine chamber 11 is slidably placed on a bottom plate 2*b* of the main body 2. The main body 2 is also provided on the top surface of the bottom plate 2*b* with a pair of guides 33 (see FIG. 11) for guiding the drawer plate 14 in the forward and rearward directions, and two stoppers 34 (see FIG. 11) for regulating the rearward movement of the drawer plate 14.

The compressor 12 and the condenser 13 are aligned along the width direction of the main body 2 so that the depth of the lower machine chamber 11 can be reduced. The air sucked into the lower machine chamber 11 with a fan motor 13*a* of the condenser 13 impinges upon a rear wall surface 11*a* of the lower machine chamber 11, and thereafter is exhausted from the lower machine chamber 11 while cooling the condenser 12. An intermediate member 35 (see FIG. 11) formed between the bottom plate 2*b* of the main body 2 and the drawer plate 14 for restricting the degree of sliding the drawer plate 14 prevents the drawer plate 14 from dropping from the lower machine chamber 11.

Figure 12:
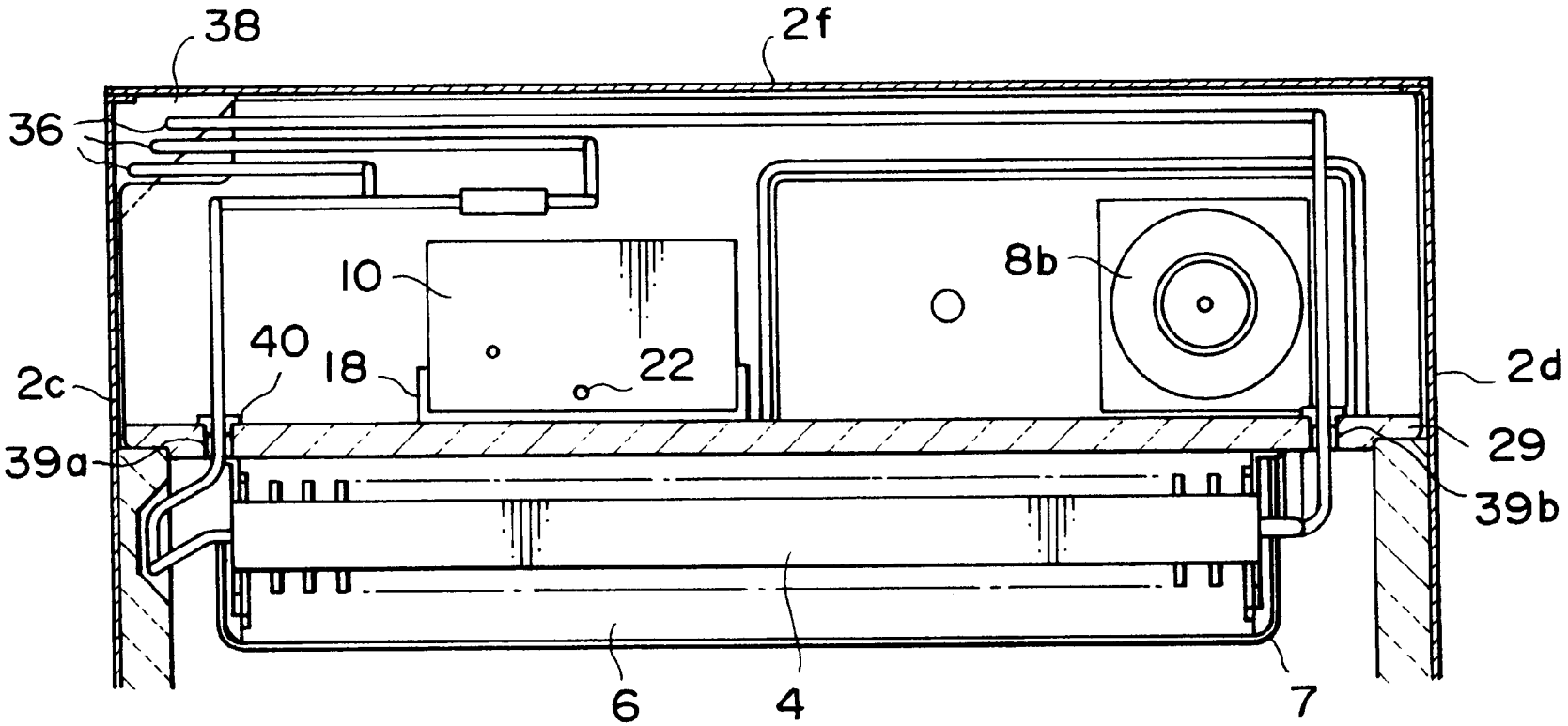
FIG. 12 is a plan view showing the upper machine chamber illustrated in FIG. 1.
Figure 13:
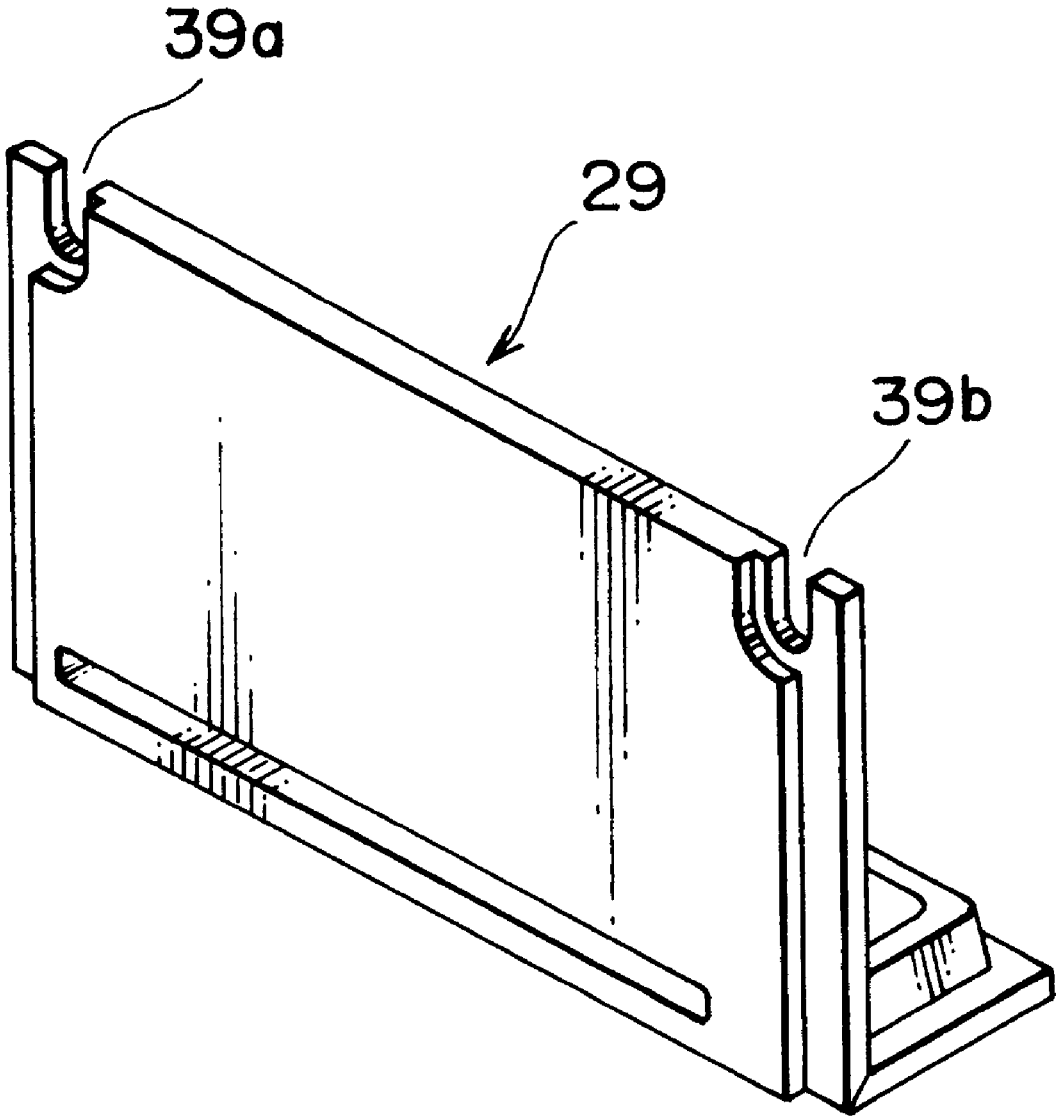
FIG. 13 is a perspective view showing a thermally insulating panel illustrated in FIG. 1.

There are refrigerant pipes 36 (see FIGS. 1 and 11) arranged between the drawer plate 14 and the rear wall surface of the lower machine chamber 11. The refrigerant pipes 36 are inserted through a pipe insertion passage 37 (see FIG. 2) formed at the lower portion of the outer surface of the ice making chamber 3 and a pipe insertion passage 38 (see FIG. 12) formed at the rear surface side of the ice making chamber 3 so as to lead into the upper machine chamber 9. The refrigerant pipes 36 are introduced into the upper machine chamber 9 and then led into the ice making chamber 3 through U-shaped cutaway portions 39*a*, 39*b* (see FIG. 13) formed in the upper end portion of the thermally insulating panel 29.

Figure 14:
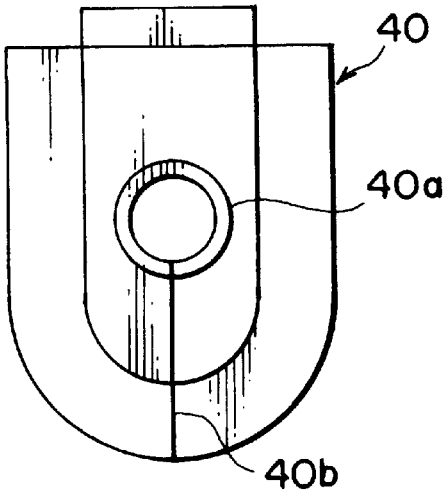
FIG. 14 is a front view showing a rubber packing to be mounted to the thermally insulating panel.
Figure 15:
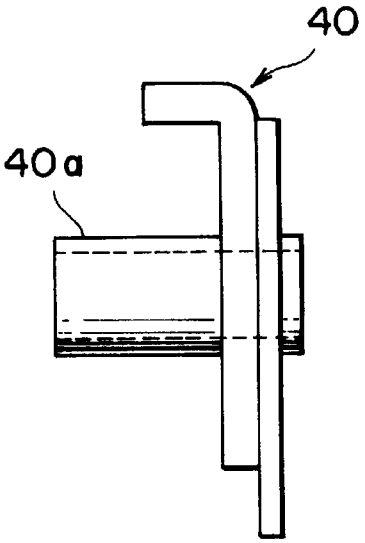
FIG. 15 is a side view showing the rubber packing.

Rubber packings 40 (see FIGS. 4 and 12) fitted into the U-shaped cutaway portions 39*a*, 39*b*, respectively, serve to prevent the cooled air from leaking into the upper machine chamber 9 from the ice making chamber 3. Each of these rubber packings 40 includes a cylindrical portion 40*a* (see FIGS. 14 and 15) covering the outer surface of each refrigerant pipe and a slit 40*b* for allowing each refrigerant pipe to be fitted into the cylindrical portion 40*a*.

Figure 3:
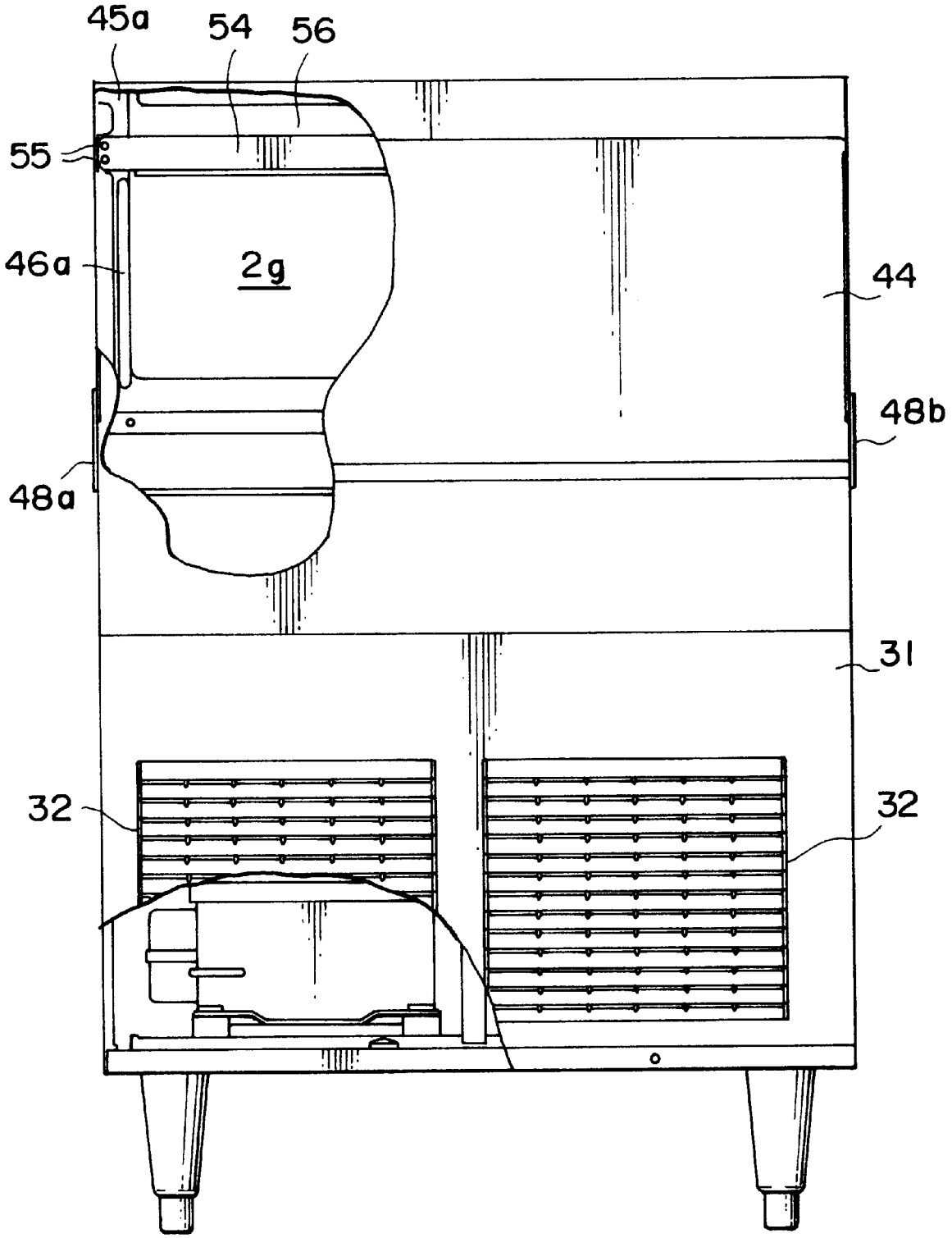
FIG. 3 is a front view showing the ice making apparatus shown in FIG. 1.
Figure 16:
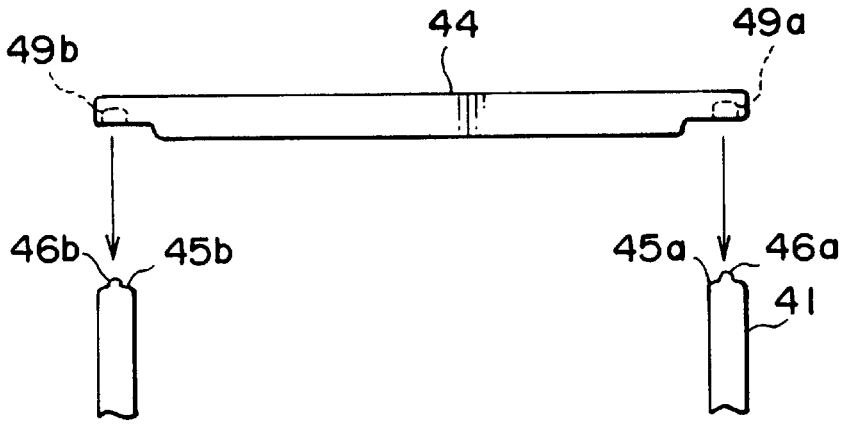
FIG. 16 is a diagram showing a lid of the ice making apparatus illustrated in FIG. 1.

The main body 2 further includes an ice reservoir box 41 for reserving ice cubes produced in the ice making unit 5, a plurality of outer plates 2*b*, 2*c*, 2*d*, 2*e*, 2*f* (see FIGS. 1 and 2) covering the outer surface of the ice reservoir box 41, and an opening 2*g* (see FIG. 3) for dispensing the ice cubes from the ice reservoir box 41. The ice reservoir box 41 is constituted by an ice reservoir box body 42 formed by molding thermoplastic resin into a predetermined shape in vacuum or by rotation, and filling foamed resin 43 into a clearance defined by the ice reservoir box body 42 and the outer plates 2*b*–2*f*. The ice reservoir box 41 also includes abutting surfaces 45*a*, 45*b* (see FIG. 16) for receiving both sides of the reverse surface of an opening/closing lid 44 when the lid 44 is closed to cover the opening 2*g*, and slender ribs 46*a*, 46*b* extending from the abutting surfaces 45*a*, 45*b*.

The ice making unit 5 is mounted onto the front surface of the thermally insulating panel 29 by a pair of brackets 47 formed at both sides of the ice making plates 5*a*, and is formed integrally with the thermally insulating panel 29. The ice cubes released from the ice making plates 5*a* in the ice making unit 5 drop onto an ice guide plate 6 disposed between the ice making unit 5 and the reservoir tank 7. The released ice cubes are then thrown into the ice reservoir box 41 from the front side of the reservoir tank 7 by the ice guide plate 6. The ice guide plate 6 includes a number of slits for introducing the ice water flowing down along the ice making surfaces of the ice making plates 5*a* into the reservoir tank 7.

The lid 44 has a substantially rectangular shape, and is pivotably supported by hinges 48*a*, 48*b* mounted to the side surface of the main body 2. The ice making apparatus 1 is formed with grooves 49*a*, 49*b* (see FIG. 16) engaging the ribs 46*a*, 46*b* of the ice reservoir box 41 on the back surface of the lid 44.

Figure 8:
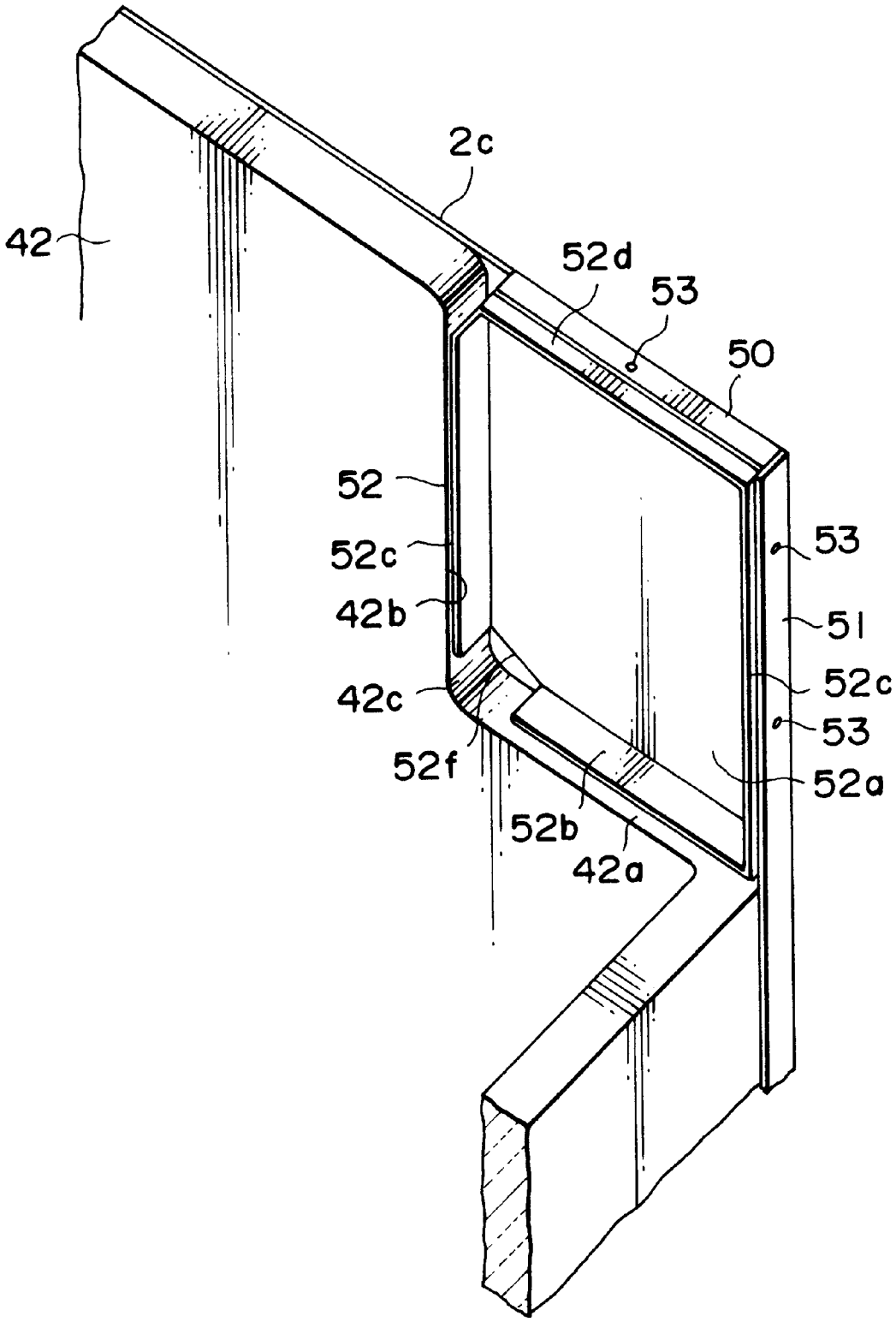
FIG. 8 is a perspective view showing a side portion of an upper machine chamber shown in FIG. 1.

As shown in FIG. 8, the ice reservoir box body 42 includes two horizontally supporting surfaces 42*a* for supporting both ends of the lower surface of the thermally insulating panel 29, two vertical surfaces 42*b* for supporting the both ends of the front surface of the thermally insulating panel 29, and arcuate surfaces 42*c* for connecting the vertical surfaces 42*b* and the supporting surfaces 42*a* to each other, respectively. Side plates 2*c*, 2*d* constituting the side surfaces of the main body 2 have, respectively, an upper end portion 50 and a rear end portion 51 (see FIG. 8) that is folded to the inside of the main body 2 substantially at a right angle.

The ice making apparatus 1 further includes a pair of deformation-suppressing members 52 (see FIG. 8) for suppressing the deformation of the horizontal surfaces 42*a* and the vertical surfaces 42*b* of the ice reservoir box body 42 caused by the foamed resin 43. Each of the deformation-suppressing members 52 has a metal plate portion 52*a* formed into substantially a rectangular shape, and abutting plate portions 52*b*, 52*c*, 52*d*, 52*e* formed by folding the periphery of the metal plate portion 52*a* substantially at a right angle. Each deformation-suppressing member 52 is secured to the inner surface of the side plates 2*c*, 2*d* by rivets 53 so that these abutting plate portions 52*b* to 52*e* can abut against the horizontal surfaces 42*a*, the vertical surfaces 42*b*, the upper end portion 50 of the side plates 2*c*, 2*d*, and the rear end portion 51 of the side plates 2*c*, 2*d*. Each deformation-suppressing member 52 also includes a cutting portion 52*f* used as an escape portion in the place corresponding to the arcuate surface 42*c* of the ice reservoir box body 42.

Figure 9:
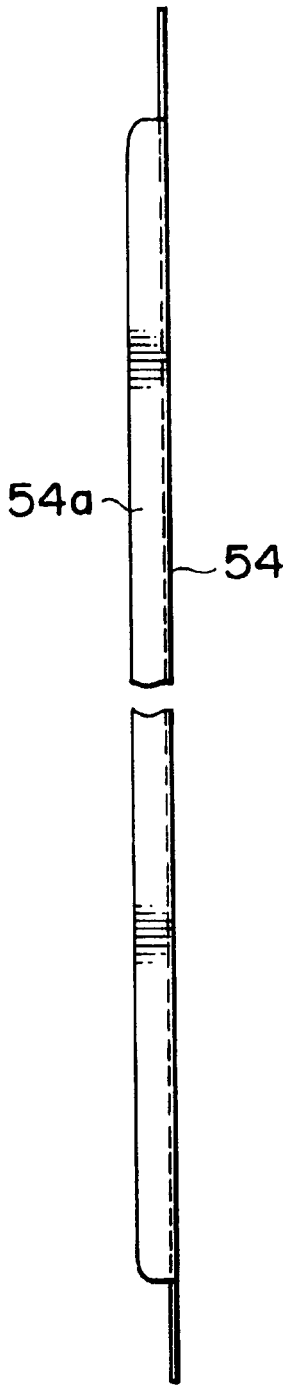
FIG. 9 is a plan view showing an enforcing beam illustrated in FIG. 3.
Figure 10:
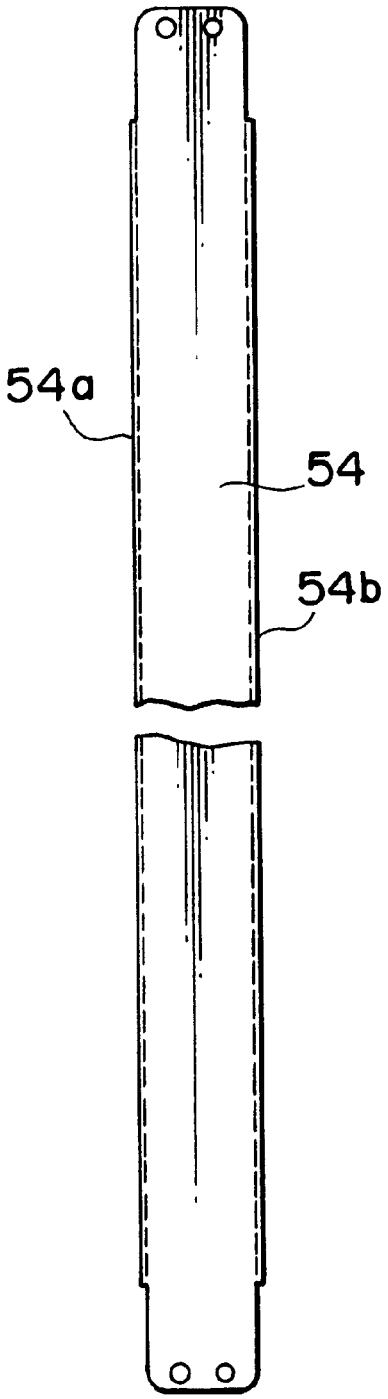
FIG. 10 is a front view showing the enforcing beam.

The ice making apparatus 1 further includes an enforcing member 56 (see FIG. 3) for enforcing the side plates 2*c*, 2*d* of the main body 2. The enforcing member 56 includes an enforcing plate 54 formed into a laterally rectangular shape, a plurality of screws 55 for securing both ends of the enforcing plate 54 to the abutting surfaces 45*a*, 45*b* of the ice reservoir box 41. The enforcing plate 54 is made of metal, and has folded portions 54*a* and 54*b* (see FIGS. 9 and 10) in the form of rectangle which come into contact with the inner surface of the ice reservoir box body 42.

Figure 5:
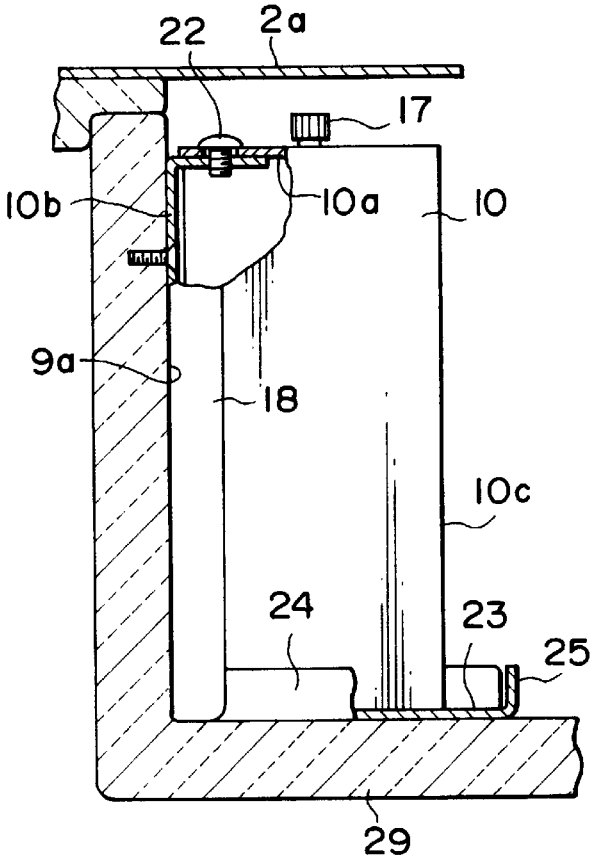
FIG. 5 is a cross-sectional view taken along the line V—V of FIG. 4.
Figure 7:
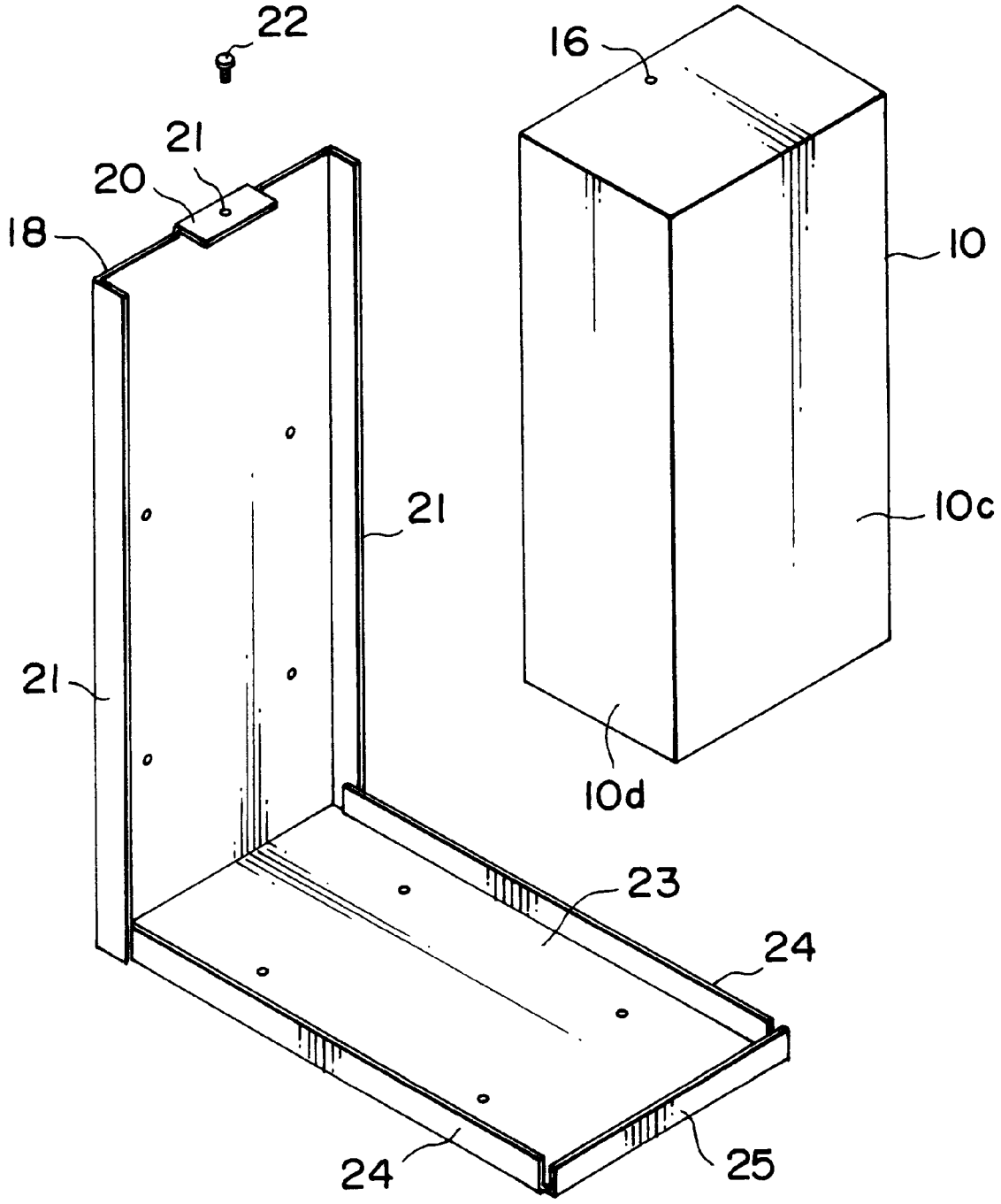
FIG. 7 is a perspective view showing a control box and a control box fixing plate shown in FIG. 3.

As shown in FIG. 5, the control box 10 is formed into a box shape while the front surface is open, and is provided with a sensitivity adjustment knob 17 for adjusting the sensitivity of an ice reservoir sensor (a gas thermostat). Further, the control box 10 is mounted to a control box fixing plate 18 (see FIG. 7) attached to the front wall surface 9*a* of the upper machine chamber 9 so that the control box fixing plate 18 may face the front surface 10*b* of the control box 10.

The control box fixing plate 18 is formed of a metal plate having a rectangular shape, including a fixing edge 20 (see FIG. 7) and a position determining portion 21. The fixing edge 20 is formed by folding the upper end portion of the control box fixing plate 18 substantially at a right angle. This allows the fixing edge 20 to be fixed to the top surface 10*a* of the control box 10 by a screw 22 inserted into the control box 10 from the top surface of the control box 10.

The position determining portion 21 is formed by folding both side edges of the control box fixing plate 18 substantially at a right angle. This allows the side surface 10*d* of the control box 10 to be positioned at a predetermined position.

The control box fixing plate 18 further includes a horizontal base plate portion 23 for supporting the lower surface of the control box 10. The base plate portion 23 horizontally extends from the lower end of the control box fixing plate 18, including guide portions 24 for guiding the side surface 10*d* of the control box 10 to the position determining portion 21, and a rear end portion 25 that is folded to face the back surface 10*c* of the control box 10. Each of the guide portions 24 is formed by folding both side edges of the base plate 23 substantially at a right angle to engage the side surface 10*d* of the control box 10.

With such an arrangement, when all the screws are removed from the top plate 2*a* of the main body 2, and thereafter the front end portion of the top plate 2*a* is lifted by hand, the top plate 2*a* is pivoted above on a fulcrum of the plate portion 26. The upper surface of the control box 10 accommodated in the upper machine chamber 9 is then exposed. When the upper surface of the control box 10 is exposed, the screw 22 can be removed by a hand extending from the front surface of the main body 2 so that the control box 10 becomes free.

Accordingly, the control box 10 can be taken out from the upper machine chamber 9 without releasing a number of screws from the control box 10 nor moving the main body 2. As a result, removal of the control box 10 accommodated in the upper machine chamber 9 of the main body 2 from the upper machine chamber 9 may be facilitated.

As described above, when all the screws are removed from the top plate 2*a* of the main body 2 and the front end portion of the top plate 2*a* is lifted by hand, the upper surface of the control box 10 accommodated in the upper machine chamber 9 can be exposed. Therefore, the control box 10 can be taken out from the upper machine chamber 9 without removing the top plate 2*a* from the main body 2.

According to the present invention, the side surface 10*d* of the control box 10 is positioned at a predetermined position by the position determining portion 21 of the control box fixing plate 18. This enables an aperture 16 (see FIG. 7) formed in the upper surface of the control box 10 to match a screw hole 21 of the fixing edge 20 when the fixing edge 20 of the control box fixing plate 18 is secured to the top surface 10*a* of the control box 10. Therefore, the fixing edge 20 of the control box fixing plate 18 can be readily secured to the top surface 10*a* of the control box 10.

Further, the guide portions 24 of the base plate portion 23 engage the side surfaces of the control box 10. These guide portions 24 of the base plate portion 23 can introduce the side surface 10*d* of the control box 10 to the position determining portion 21 of the control box fixing plate 18 when the fixing edge 20 of the control box fixing plate 18 is secured to the ceiling surface 10*a* of the control box 10. This arrangement makes it possible to prevent the electrical components from being damaged due to impingement upon the position determining portion 21 of the control box fixing plate 18.

Further, when the control box 10 is taken out from the upper machine chamber 9, the back surface 10*c* of the control box 10 is impinged upon the rear end portion 25 of the base plate portion 23. For this, it can be readily confirmed whether the fixing edge 20 of the control box fixing plate 18 has been pulled out of the control box 10.

Still further, since the control box fixing plate 18 is formed by folding a metal plate into an L shape, the shape of the thermally insulating panel 29 can be kept as an L shape by means of the control box fixing plate 18. Furthermore, the control box fixing plate 18 includes folded portions 21, 24, to thereby improve rigidity of the control box fixing plate 18. Therefore, strength sufficient to keep the thermally insulating panel 29 at a predetermined shape can be ensured.

According to the invention, deformation of the horizontal surfaces 42*a* and the vertical surfaces 42*b* of the ice reservoir box body 42 can be suppressed by the deformation-suppressing members 52. For this reason, no gap is formed between the horizontal surfaces 42*a* of the ice reservoir box body 42 and the lower surface of the thermally insulating panel 29, or between the vertical surfaces 42*b* of the ice reservoir box body 42 and the front surface of the thermally insulating panel 29. Therefore, this can prevent a leak of the cooled air from the ice making chamber 3 to the upper machine chamber 9.

Furthermore, since the side plates 2*c*, 2*d* of the main body 2 are enforced by the metal plate 54, the top plate 2*a* can be readily screwed to the side surface of the main body 2.

Various details of the present invention may be changed without departing from its spirit nor its scope. Furthermore, the foregoing description of the embodiments according to the present invention is provided for the purpose of illustration only, and not for the purpose of limiting the present invention as defined by the appended claims and their equivalents.

What is claimed is:

1. An ice making apparatus comprising:

an ice making unit including an ice making plate having an ice making surface, and including a water sprinkler for sprinkling ice water on said ice making surface of said ice making plate;

a reservoir tank for receiving the ice water flowing down along said ice making surface of said ice making plate;

a feed pump including a pump section for supplying the ice water received by said reservoir tank to said water sprinkler, and including a motor section for driving said pump section;

a main body including an ice making chamber for accommodating said ice making unit and said reservoir tank, said main body comprising a thermally insulating panel forming an upper machine chamber partitioned from said ice making chamber at a back portion of said ice making chamber, and comprising a top plate forming a ceiling surface of said upper machine chamber;

a control box, said motor section of said feed pump and said control box being accommodated in said upper machine chamber; and a control box fixing plate attached to a front wall surface of said upper machine chamber so as to face a front surface of said control box, said control box being detachably mounted to said front wall surface of said upper machine chamber by said control box fixing plate, said control box fixing plate including a fixing edge detachably connected to a top surface of said control box by a screw, wherein said fixing edge is formed by folding an upper end portion of said control box fixing plate at a substantially right angle.

2. The ice making apparatus of claim 1, wherein said control box has a box shape having an open front surface.

3. An ice making apparatus comprising:

an ice making unit including an ice making plate having an ice making surface, and including a water sprinkler for sprinkling ice water on said ice making surface of said ice making plate;

a reservoir tank for receiving the ice water flowing down along said ice making surface of said ice making plate;

a feed pump including a pump section for supplying the ice water received by said reservoir tank to said water sprinkler, and including a motor section for driving said pump section;

a main body including an ice making chamber for accommodating said ice making unit and said reservoir tank, said main body comprising a thermally insulating panel forming an upper machine chamber partitioned from said ice making chamber at a back portion of said ice making chamber, and comprising a top plate forming a ceiling surface of said upper machine chamber;

a control box, said motor section of said feed pump and said control box being accommodated in said upper machine chamber; and a control box fixing plate attached to a front wall surface of said upper machine chamber so as to face a front surface of said control box, said control box being detachably mounted to said front wall surface of said upper machine chamber by said control box fixing plate, said control box fixing plate including a fixing edge detachably connected to a top surface of said control box by a screw, and including position determining portions for positioning side surfaces of said control box at a predetermined position.

4. The ice making apparatus of claim 3, wherein said control box has a box shape having an open front surface.

5. The ice making apparatus of claim 3, wherein said control box fixing plate has two side edges, said position determining portions being formed by folding said two side edges of said control box fixing plate at substantially right angles.

6. The ice making apparatus of claim 3, wherein said control box fixing plate further includes a horizontal base plate portion for supporting a lower surface of said control box, said horizontal base plate portion having guide portions for guiding the side surfaces of said control box to said position determining portions.

7. An ice making apparatus comprising:

an ice making unit including an ice making plate having an ice making surface, and including a water sprinkler for sprinkling ice water on said ice making surface of said ice making plate;

a reservoir tank for receiving the ice water flowing down along said ice making surface of said ice making plate;

a feed pump including a pump section for supplying the ice water received by said reservoir tank to said water sprinkler, and including a motor section for driving said pump section;

a main body including an ice making chamber for accommodating said ice making unit and said reservoir tank, said main body comprising a thermally insulating panel forming an upper machine chamber partitioned from said ice making chamber at a back portion of said ice making chamber, and comprising a top plate forming a ceiling surface of said upper machine chamber;

a control box, said motor section of said feed pump and said control box being accommodated in said upper machine chamber; and a control box fixing plate attached to a front wall surface of said upper machine chamber so as to face a front surface of said control box, said control box being detachably mounted to said front wall surface of said upper machine chamber by said control box fixing plate, said control box fixing plate including a fixing edge detachably connected to a top surface of said control box by a screw, and including a horizontal base plate portion for supporting a lower surface of said control box.

8. The ice making apparatus of claim 7, wherein said control box has a box shape having an open front surface.

9. The ice making apparatus of claim 7, wherein said horizontal base plate portion has guide portions for guiding side surfaces of said control box.

10. The ice making apparatus of claim 9, wherein said horizontal base plate portion has two side edges, said guide portions being formed by folding said two side edges of said horizontal base plate portion at substantially right angles.

11. The ice making apparatus of claim 7, wherein said horizontal base plate portion includes a rear portion folded so as to face a back surface of said control box.

* * * * *